US010088281B2

(12) United States Patent
Kaufman

(10) Patent No.: US 10,088,281 B2
(45) Date of Patent: Oct. 2, 2018

(54) AUTOMATED TARGET APPARATUS WITH CONTROLLED TRANSLATION AND ROTATION

(71) Applicant: Gary Kaufman, Fort Wayne, IN (US)

(72) Inventor: Gary Kaufman, Fort Wayne, IN (US)

(73) Assignee: Targamite LLC, Fort Wayne, IN (US)

( * ) Notice: Subject to any disclaimer, the term of this patent is extended or adjusted under 35 U.S.C. 154(b) by 0 days.

(21) Appl. No.: 15/205,950

(22) Filed: Jul. 8, 2016

(65) Prior Publication Data

US 2017/0010076 A1 Jan. 12, 2017

Related U.S. Application Data

(60) Provisional application No. 62/189,948, filed on Jul. 8, 2015.

(51) Int. Cl.
*F41J 7/06* (2006.01)
*F41J 9/00* (2006.01)

(52) U.S. Cl.
CPC ... *F41J 7/06* (2013.01); *F41J 9/00* (2013.01)

(58) Field of Classification Search
CPC ..... F41J 7/00–7/06; F41J 9/00–9/02
USPC ..... 273/359, 369, 370, 390–392, 406
See application file for complete search history.

(56) References Cited

U.S. PATENT DOCUMENTS 2,135,667 A 11/1938 Johnson
2,161,012 A 6/1939 Breitenstein
4,222,564 A * 9/1980 Allen ..... F41J 5/00 273/369
4,614,345 A 9/1986 Doughty
4,743,032 A * 5/1988 Summers ..... F41J 7/00 273/372
5,350,180 A * 9/1994 Acock ..... F41J 7/06 273/406
5,568,927 A 10/1996 Badorrek
5,868,396 A 2/1999 Theissen
6,645,037 B1 11/2003 Choi
7,293,774 B1 11/2007 Shawd
7,357,394 B2 4/2008 Halverson
7,900,927 B1 * 3/2011 Bliehall ..... F41J 9/02 273/359
8,029,198 B2 10/2011 Ko
8,655,257 B2 2/2014 Spychaiski
8,777,226 B1 * 7/2014 Decker, Jr. ..... F41J 7/06 273/406
2006/0290063 A1 * 12/2006 Hagar ..... F41J 7/06 273/369
2008/0150235 A1 * 6/2008 Bliehall ..... A63B 63/06 273/359
2008/0224410 A1 * 9/2008 Bengtsson ..... F41J 7/06 273/359
2013/0285328 A1 * 10/2013 Rahmanian ..... F41J 1/10 273/359
2014/0217674 A1 * 8/2014 Kochuba ..... F41J 9/00 273/359

(Continued)

*Primary Examiner* — Mark Graham
(74) *Attorney, Agent, or Firm* — Carson LLP; Michael D. Smith

(57) ABSTRACT

An apparatus for randomly moving a target in space, comprising: a drive assembly disposed within a housing, an electric motor, a programmable controller, and a moving attachment arm, adapted to move vertically, horizontally, along a curved path, and along a linear path in response to instructions from the controller.

6 Claims, 13 Drawing Sheets

(56) References Cited

U.S. PATENT DOCUMENTS

| | | | | |
|---|---|---|---|---|
| 2015/0102563 | A1* | 4/2015 | Gwash | F41J 7/06<br>273/390 |
| 2015/0233685 | A1* | 8/2015 | Dennison | F41J 9/02<br>273/369 |
| 2016/0216084 | A1* | 7/2016 | Foege | F41J 7/04 |

* cited by examiner

AUTOMATED TARGET APPARATUS WITH CONTROLLED TRANSLATION AND ROTATION

CROSS REFERENCE TO RELATED APPLICATIONS

The present application claims the benefit of U.S. provisional patent application Ser. No. 62/189,948, entitled "Automated Target Apparatus With Controlled Translation and Rotation", filed Jul. 8, 2015, the disclosure of which is incorporated herein by reference.

BACKGROUND

1. Field of the Invention

The present invention relates to a moving target for shooting practice and, more particularly, to a portable, programmable target that translates and rotates randomly in response to instructions from a controller.

2. Description of the Related Art

The related known prior art fails to teach or suggest all of the function and advantages of the present invention.

For example, U.S. Pat. No. 2,135,667 discloses an electric shooting gallery employing a light gun and photo-electric targets and mechanism for controlling the movement of these targets in a particular manner.

U.S. Pat. No. 2,161,012 discloses a shooting gallery type of amusement game in which a moving target structure is provided, along with a photo-electric cell, sensitive to a ray of light shot from a light producing gun or aiming element to cause operation of the target structure.

U.S. Pat. No. 4,614,345 discloses a steel target that rocks upon impact from a bullet and resets itself under its own counterweight design.

U.S. Pat. No. 5,568,927 discloses a three-dimensional moving target system comprising a track assembly and a structure for supporting the target in an upright position from the track assembly.

U.S. Pat. No. 5,868,396 discloses a movable target for shooting practice, comprising a multiplicity of rail track sections, which can be joined together, and a carriage which can be displaced along the assembled rail-track sections by means of a carriage drive and receives a target arrangement, whose target-retaining means, which receives at least one target such that it can be exchanged, can be moved between a neutral position and a target position by means of a target drive. The rail-track sections exhibit feet, which can be stacked one inside the other, and complementary connecting parts at the ends, and provision is made for end-side buffer stops with corresponding connecting parts, the carriage exhibiting, at one end, transporting wheels which are connected releasably to said carriage and of which the diameter is greater than that of the carriage wheels, and, at the opposite end, a handle.

U.S. Pat. No. 6,645,037 discloses a programmable device that can be activated by a user to set up any one or multiple different motions of the device, for instance, a shooting target.

U.S. Pat. No. 7,293,774 discloses a moving shooting target system for providing a first stationary target that triggers a second moving target when stricken with a bullet. The moving shooting target system includes a frame with a shooting opening and a target reservoir, a first target attached to a support member, and a stopper member attached to the support member. The stopper member releases at least one second target from the target reservoir when the first target is stricken by a bullet. The released second target rolls along and through the shooting opening where a shooter is able to shoot the released second target.

U.S. Pat. No. 7,357,394 discloses a modular, expandable, and portable shooting range system. The system can include one or more shooting modules that mount together to provide different numbers of shooting lanes with various lengths. The shooting modules are pre-engineered with removable panels to permit additional shooting modules to be added on as customer orders. This configuration also permits adding to the length of the shooting range to accommodate firing of different weapons. The shooting range system can further include a control booth which is divided from the shooting lanes. The control booth can be integrally formed with the shooting modules, or can be separate. The control booth can include a module control which allows a person to control lighting, air, and target control systems of the shooting range system, and can further provide a safe location to view the range.

U.S. Pat. No. 8,029,198 discloses a pivot driving portion including a platform, a vertical driving portion connection portion rotatably installed on the platform, and a pivot driving portion including a motor which rotates the vertical driving portion connection portion. The vertical driving portion includes a pivot driving portion connection portion connected to an upper side of the vertical driving portion connection portion, a column standing on the pivot driving portion connection portion, a mount rotatably arranged in an upper portion of the column, and a motor rotating the mount with respect to the column. The rotation shaft of the vertical driving portion connection portion of the pivot driving portion and the rotation shaft of the vertical driving portion mount intersect each other.

U.S. Pat. No. 8,655,257 discloses a mobile base unit, a target body and an unattached control system. The base unit has a chassis plate driven by a plurality of motors and a plurality of wheel assemblies within an exterior armor which protects internal components of the chassis from projectile impacts. The target body mounts to an extension plate affixed to the underside of the chassis plate of the base unit, creating a subject that moves in varying directions.

Upon review of the prior art, one observes that what is needed in the art is a constant motion, randomly moving translating and rotating target having a smooth motion.

SUMMARY

In a first exemplary embodiment, the present invention comprises an apparatus for randomly moving a target in space, said apparatus comprising: a drive assembly disposed within a housing, said drive assembly comprising: an electric motor, a controller, and a moving attachment device, said electric motor operably attached to said controller and to said moving attachment device, said moving attachment device adapted to move vertically and horizontally in response to instructions from said controller; a shaft, said shaft having a first end and a second end, said first end of said shaft attached to said moving attachment device of said drive assembly; and a target, said target removably attached to said second end of said shaft.

In another exemplary embodiment, the present invention comprises an apparatus for randomly moving a target in space, said apparatus comprising: a drive assembly disposed within a housing, said drive assembly comprising: an electric motor, a controller, and a moving attachment device, said electric motor operably attached to said controller and to said moving attachment device, said moving attachment device adapted to move along a path in response to instructions from said controller; a shaft, said shaft having a first end and a second end, said first end of said shaft attached to said moving attachment device of said drive assembly; and a target, said target removably attached to said second end of said shaft.

In still another exemplary embodiment, the present invention comprises an apparatus for randomly moving a target in space, said apparatus comprising: a drive assembly disposed within a housing, said drive assembly comprising: an electric motor, a controller, and a moving attachment device, said electric motor operably attached to said controller and to said moving attachment device, said moving attachment device adapted to move vertically, horizontally, along a curved path, and along a linear path in response to instructions from said controller; a shaft, said shaft having a first end and a second end, said first end of said shaft attached to said moving attachment device of said drive assembly; and a target, said target removably attached to said second end of said shaft.

BRIEF DESCRIPTION OF THE DRAWINGS

The present invention will be understood more fully from the detailed description given hereinafter and from the accompanying drawings of the preferred embodiment of the present invention, which, however, should not be taken to limit the invention, but are for explanation and understanding only.

In the drawings:

FIG. 13 shows partial major subassemblies of the control module, wherein:

Corresponding reference characters indicate corresponding parts throughout the several views. The exemplary embodiments set forth herein are not to be construed as limiting the scope of the invention in any manner.

DETAILED DESCRIPTION OF THE EMBODIMENTS

The present invention will be discussed hereinafter in detail in terms of various exemplary embodiments according to the present invention with reference to the accompanying drawings. In the following detailed description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessary obscuring of the present invention.

Thus, all of the implementations described below are exemplary implementations provided to enable persons skilled in the art to make or use the embodiments of the disclosure and are not intended to limit the scope of the disclosure, which is defined by the claims. As used herein, the word "exemplary" or "illustrative" means "serving as an example, instance, or illustration." Any implementation described herein as "exemplary" or "illustrative" is not necessarily to be construed as preferred or advantageous over other implementations.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
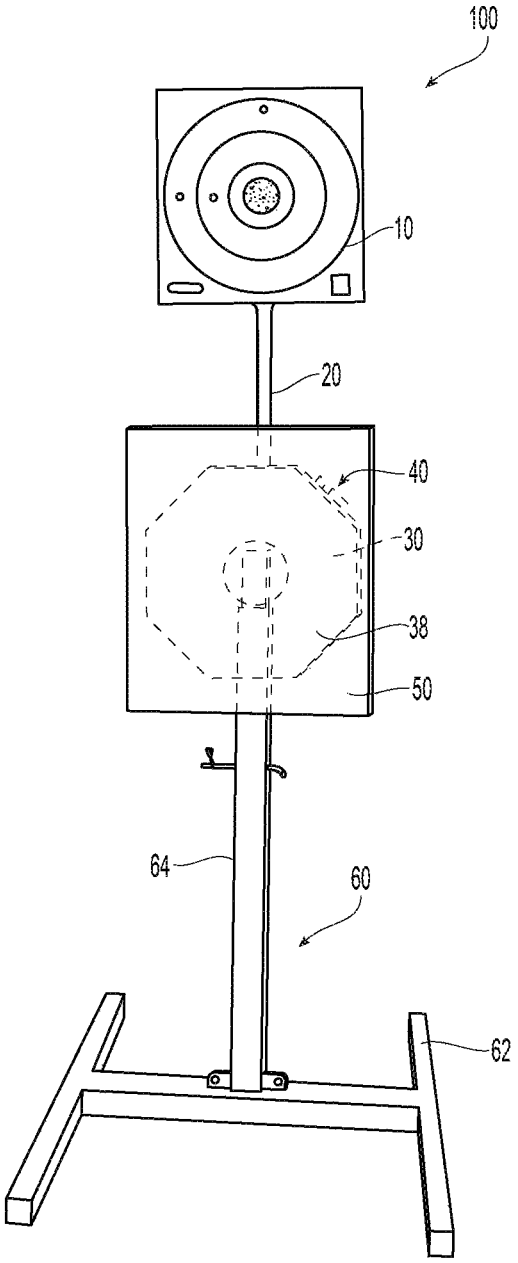
FIG. 1 shows a front view of an exemplary apparatus embodiment according to the present invention, with the outline of its control module shown in dashed lines behind a protective plate.

Referring first to FIG. 1, there is shown target apparatus 100 in accordance with the present invention. As illustrated in FIG. 1, apparatus 100 generally comprises target 10, swing arm 20, control module 30, control panel 40 of control module 30, protective plate 50 behind which control module 30 is disposed, and stand 60. Plate 50 ballistically shields control module 30 from impact by bullets fired at target 10. Stand 60 includes base 62 and stanchion 64. Control module 30 and plate 50 are each individually mountable to stanchion 64, which is disposed therebetween, with the front-facing side of control module 30 interfacing the rear-facing side of plate 50. Stand 60 is configured to support control module 30 and protective plate 50 while swing arm 20 and target 10 are unmoving or are moving linearly and/or rotationally in the directions indicated by arrows 70 and 74 shown in FIG. 2.

Figure 6:
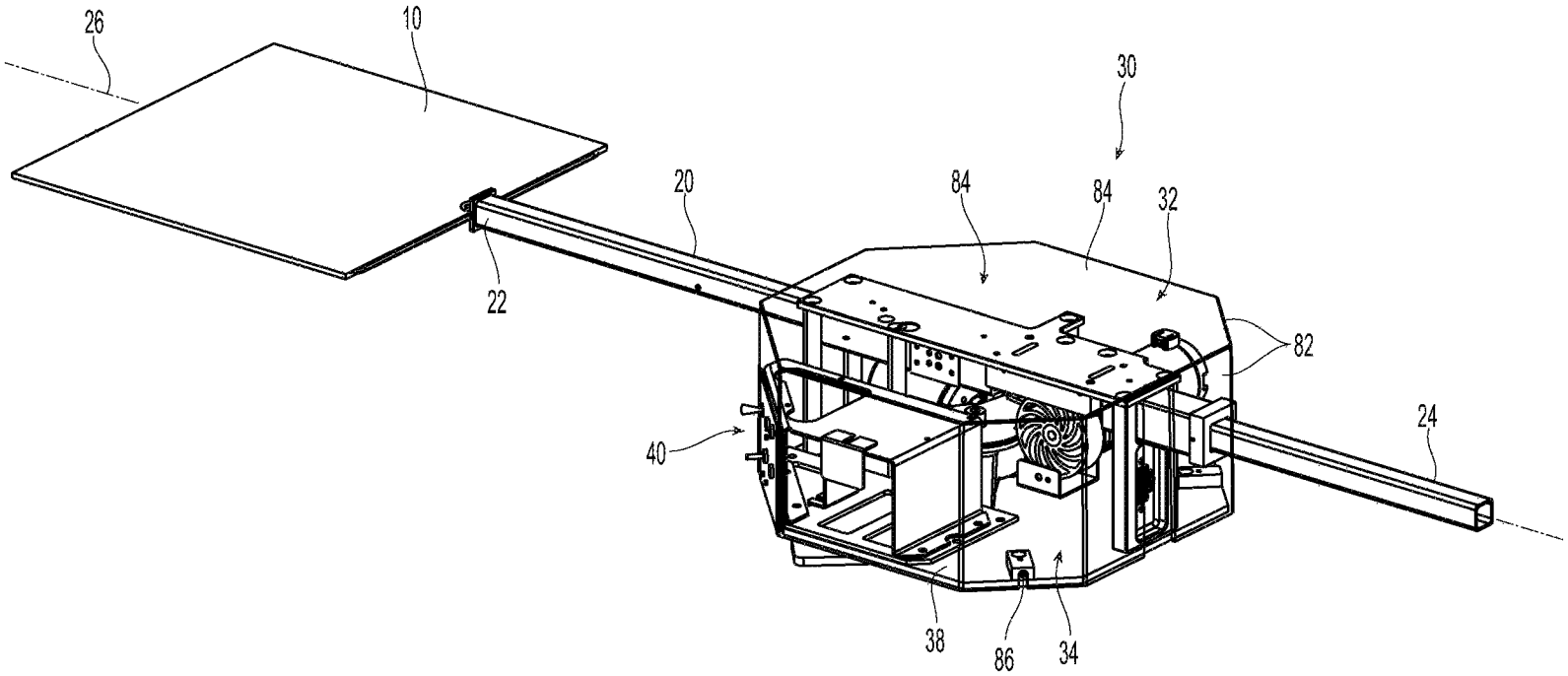
FIG. 6 shows a partial perspective view of the rear of a control module, swing arm and target of an apparatus embodiment according to the present invention, wherein a portion of the control module housing is indicated by outlines and its exterior surfaces omitted, whereby certain control module componentry located within the housing are shown.
Figure 7:
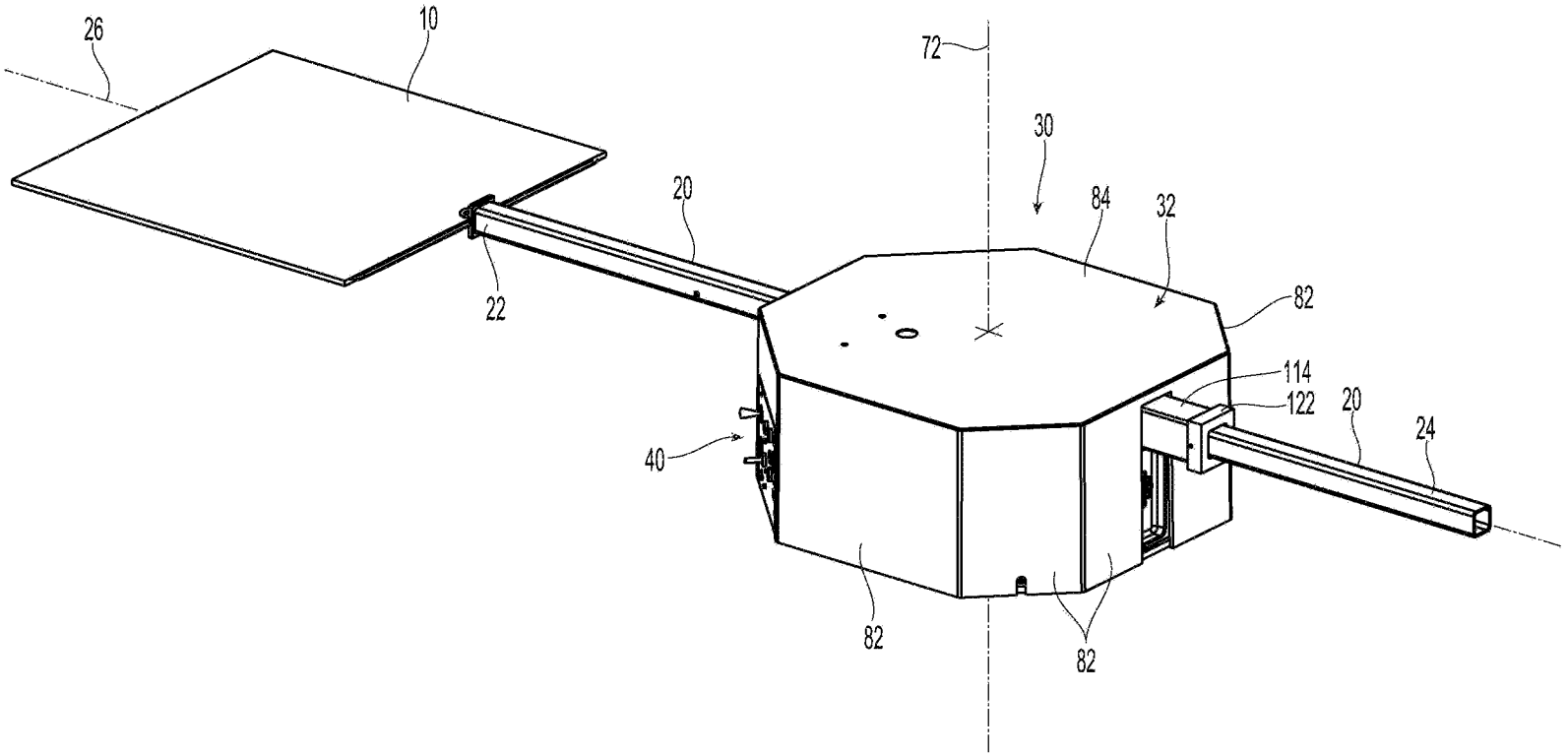
FIG. 7 shows the perspective view of FIG. 6 with exterior surfaces of the control module housing shown.
Figure 8:
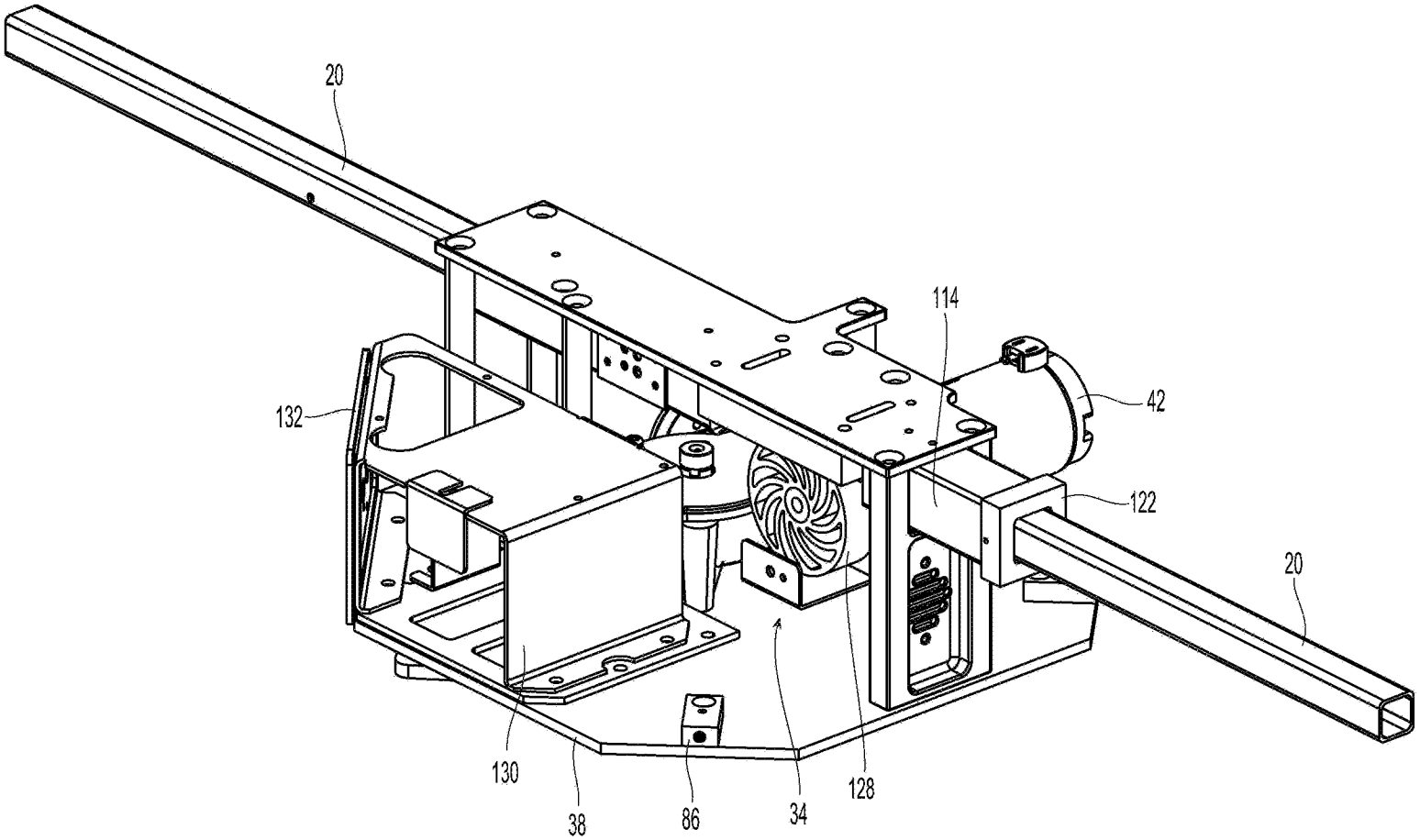
FIG. 8 shows another partial rear perspective view of a portion of the control module and swing arm of FIG. 6, with a portion of the housing omitted, whereby certain control module componentry internal to the control module are shown.

Swing arm 20 is straight and has a generally elongated shape that extends between a first end 22 and an opposite second end 24. In the shown embodiments, swing arm 20 has a square, hollow cross-section, as best seen in FIGS. 6 and 7. The first end 22 of swing arm 20 is removably attached to target 10, which may comprise any known material used for shooting targets including, without limitation, aluminum or other light metals, paper, rubber, or plastic. As further shown in FIGS. 1 and 2, target 10 may include concentric circles or other visual media.

Figure 2:
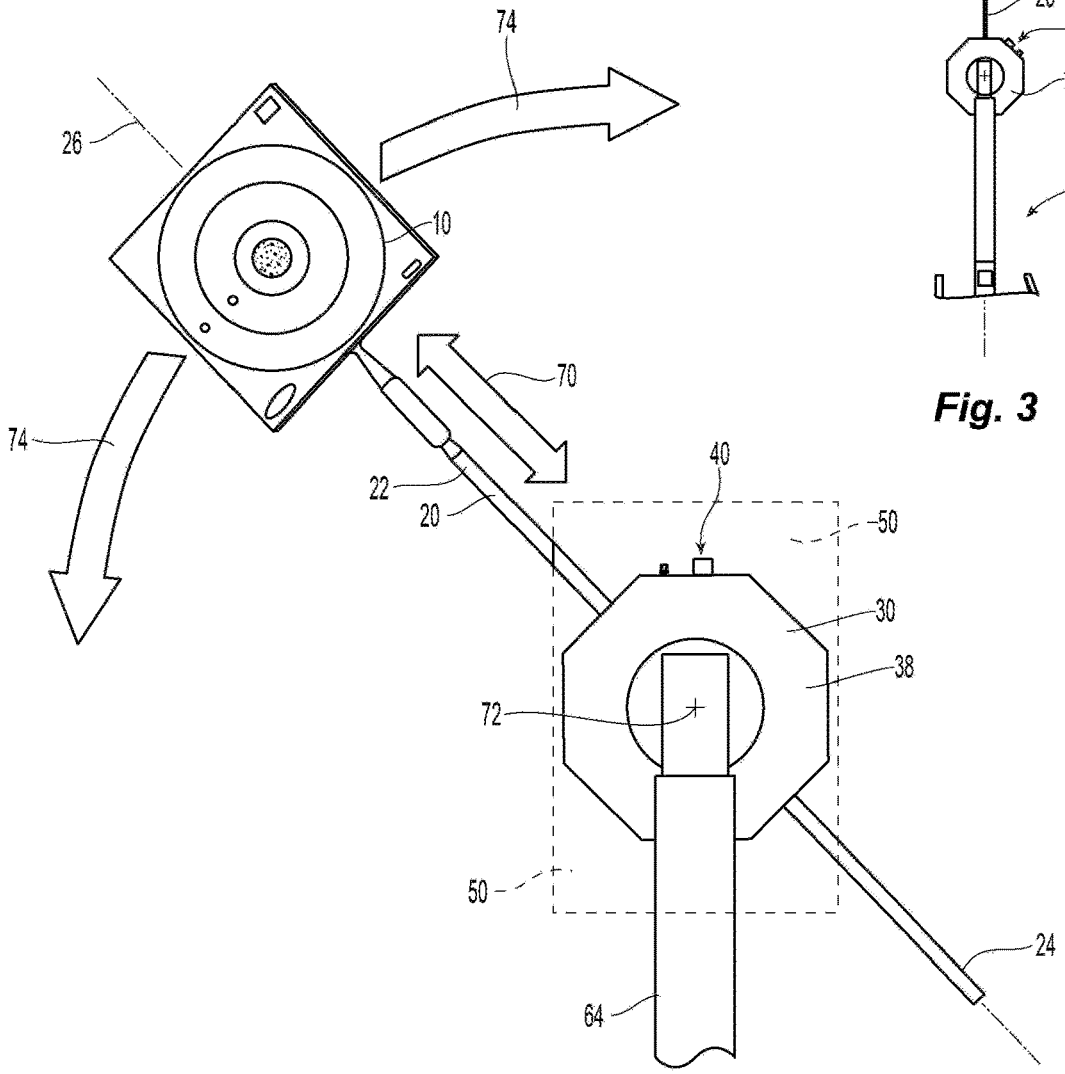
FIG. 2 shows a front operational view of the apparatus of FIG. 1 with the protective plate shown in dotted lines, showing directions of target movement.
Figure 3:
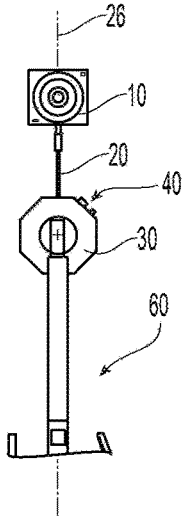
FIG. 3 shows a front operational view of the apparatus of FIG. 2 with the protective plate removed and its control module, swing arm and target located at one of various, randomly located positions.
Figure 4:
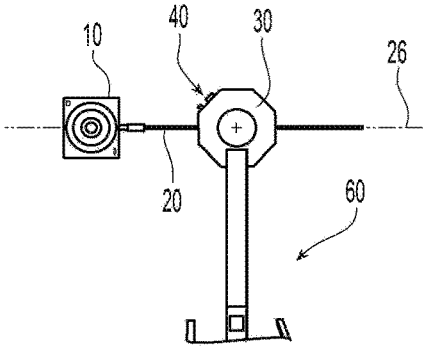
FIG. 4 shows a front operational view of the apparatus of FIG. 2 with the protective plate removed and its control module, swing arm and target located at another one of various, randomly located positions.

Referring now to FIGS. 2 to 4 and FIGS. 6 to 10, swing arm 20 is connected to and extends through the housing 32 of control module 30. Swing arm 20 is adapted move longitudinally relative to control module 30 along axis 26 in the directions indicated by double-headed arrow 70 (FIG. 2). Additionally, swing arm 20 is adapted to rotate about control module axis of rotation 72 in the directions indicated by arrows 74, which preferably allows target 10 to be moved in an arc of at least 180 degrees and preferably up to almost 360 degrees about control module axis of rotation 72, and may, for example, pass through and/or assume the positions shown in FIGS. 3 and 4 during operation of target apparatus 100. Thus, target 10 is randomly moveable linearly and angularly in multiple directions. In some embodiments, swing arm 20 is also pivotally connected to control module 30 such that target 10 can move closer to or farther away from a shooter using the device. In this manner, apparatus 100 of the present invention uniquely allows target 10 to move in more than one plane relative to a shooter/user of apparatus 100.

Control module 30 includes drive assembly 34 disposed within control module housing 32. In the illustrated embodiment of apparatus 100 target 10 is able to translate along the longitudinal axis 26 of swing arm 20, and/or move angularly about axis of rotation 72 under the influence of drive assembly 34 as directed by a controller 36 disposed within housing 32 of control module 30.

In the embodiments of apparatus 100 depicted herein, drive assembly 34 includes first electric motor 42 and second electric motor 44, which are best seen in FIGS. 9, 11, 13A, 13B, 14 and 15. First motor 42 is adapted to move swing arm 20 and target 10 along a linear path defined by the longitudinal axis 26 of swing arm 20. Second motor 44 is adapted to rotate control module 30, and thus swing arm 20 and target 10, relative to stand 60 about control module axis of rotation 72. The present invention further comprises one or more position sensors to provide information about target location and speed to the control module 30.

Figure 5:
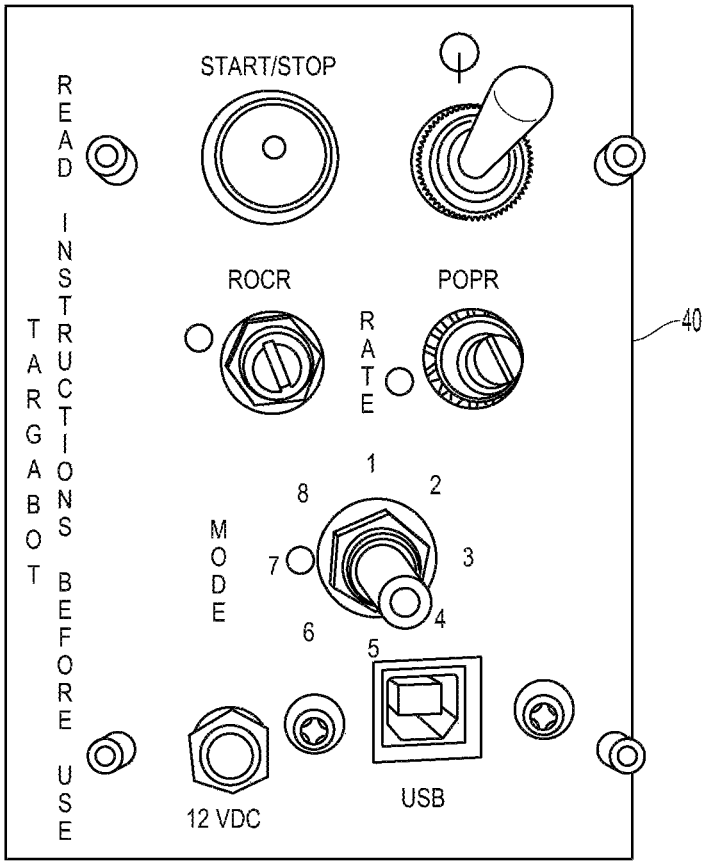
FIG. 5 shows a view of a control panel face for an apparatus embodiment according to the present invention.

Controller 36 includes a preprogrammed or programmable microprocessor or other logic device. Controller 36 is operably connected to each of motors 42 and 44, and is in electrical communication with control panel 40 shown in FIG. 5. Control panel 40 may include a plurality of analog or digital inputs. As illustrated in FIG. 5, inputs to control panel 40 may include an on/off switch, a USB input, a mode dial, a speed control dial, and a range control dial. Target apparatus embodiments according the present invention further comprise software that includes preset operating modes defining, speed, path, and duration. However, the present invention further comprises user interfaces, such as a USB interface, that allows programming by graphical user interface or free form using a PC or other user interface. The present invention preferably further comprises means of receiving remote operating instructions using a radio frequency remote control or Bluetooth® receiving device.

In one exemplary embodiment, the controller 36 receives input from pressure transducers functionally connected to target 10. Input from said transducers is relayed to control module 30 as an input to the microprocessor program for motion of swing arm 20. Such input from the transducers may be used by the controller of control module 30 to alter the speed or path of target 10.

Apparatus 100 preferably includes an AC Charger that takes standard 120 Volt AC house current and converts it to 12 Volts DC current for charging of an on-board battery of control module 30.

Figure 9:
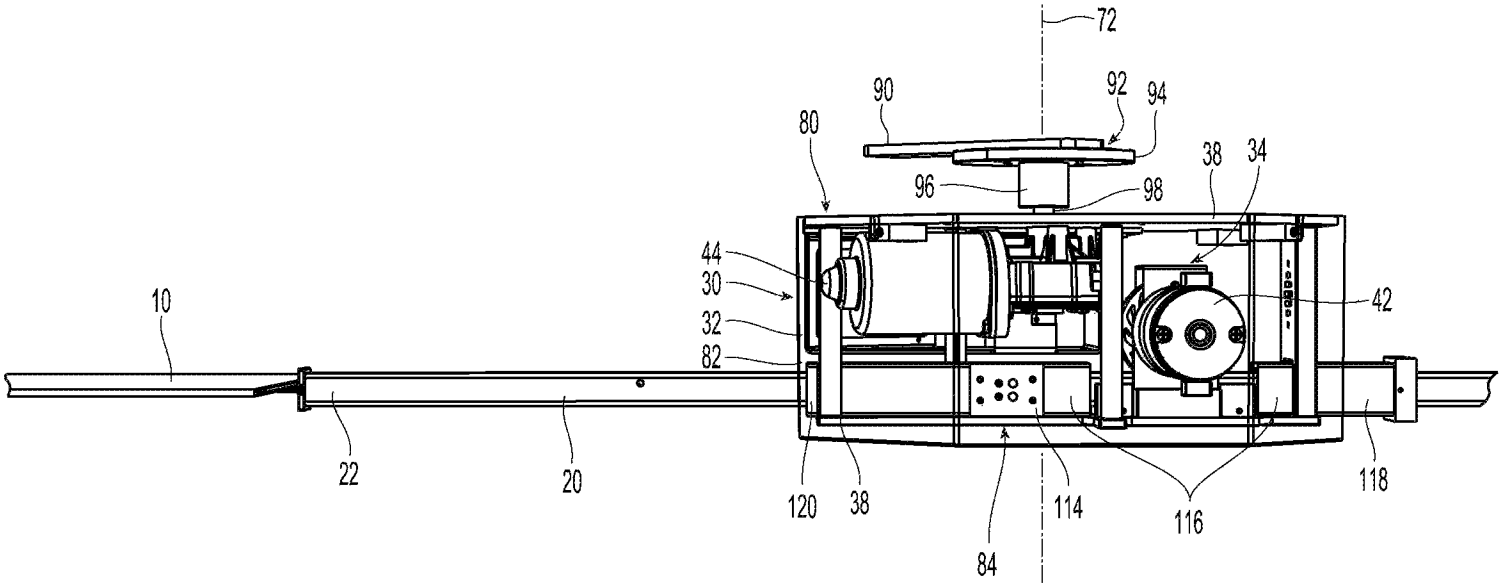
FIG. 9 shows a partial side view of the control module, swing arm and target of the apparatus embodiment of FIG. 6, wherein a portion of the control module housing is indicated by outlines and its exterior surfaces omitted, whereby certain control module componentry located within the housing are shown.
Figure 10:
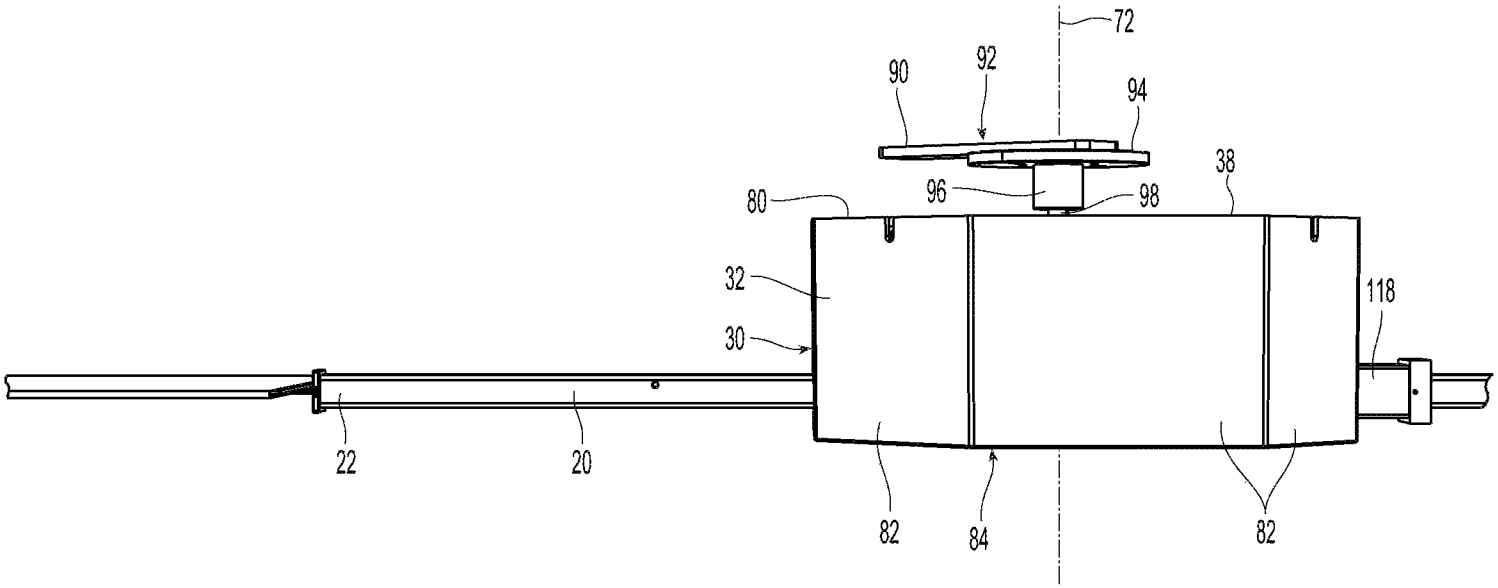
FIG. 10 shows the side view of FIG. 9 with exterior surfaces of the control module housing shown.
Figure 11:
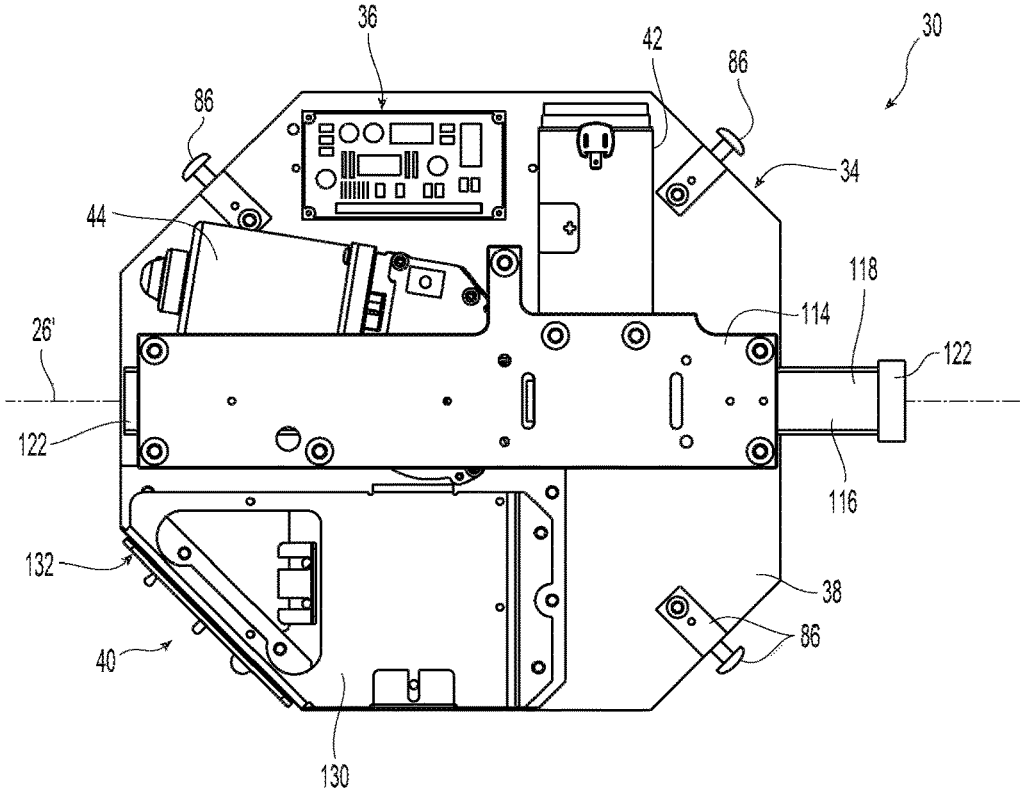
FIG. 11 shows a rear view of the control module of FIG. 6 with a portion of the housing removed.
Figure 12:
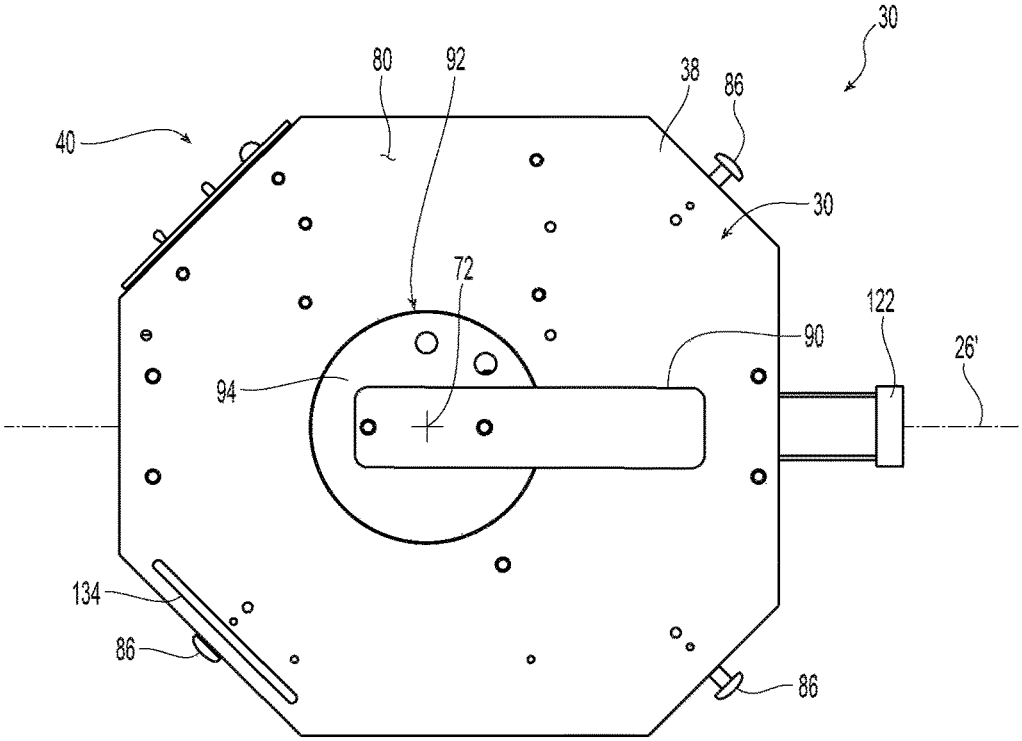
FIG. 12 shows a front view of the control module of FIG. 6.

Referring to FIGS. 6 to 12, control module housing 32 comprises plate 38 that defines a control module chassis to which drive assembly 34 is attached. During use of apparatus 100, exterior surface 80 of plate 38 and the front side of protective plate 50 oppose a shooter aiming at the face of target 10. In the depicted embodiment, control module plate 38 is planar, with axis 72 generally normal thereto, as best seen in FIGS. 9 and 10. Control module housing 32 defines one or more circumferential sidewalls 82 extending rearward from plate 38. In the depicted embodiment, housing 32 is octagonal, thus approximating a cylindrical shape, with control panel 40 attached to one of the eight housing sides. Axis 26, along which swing arm 20 is oriented and moveable, extends through diametrically opposite sidewalls 82.

Control module housing 32 of the depicted embodiment defines planar rear wall 84 that is substantially parallel with plate 38. Portions of the housing sidewall(s) 82 may be integrally formed with housing rear wall 84, and plate 38 and sidewall(s) 82 are selectively attached through mating fasteners 86 to secure housing 32 to enclose the interior of control module 30.

As best seen in FIGS. 2, 9, 10 and 12, control module 30 is mounted to stanchion 64 through mounting tongue 90 of hanger mount 92, which is receivable into the upper end of stanchion 64, whereby the position and orientation of hanger mount 92 are fixed relative to stand 60 during operation of apparatus 100. Hanger mount 92 is disposed adjacent to the front, exterior surface 80 of plate 38, with tongue 90 extending radially relative to axis 72. In the depicted embodiment, tongue 90 is affixed to and extends beyond the periphery of hub 94 of hanger mount 92. Hub 94 defines a circular flange portion from which axially extends cylindrical collar portion 96. Collar portion 96 is receivable of the forward end of drive shaft 98 that extends along axis 72 through plate 38. Collar 96 and drive shaft 98 are secured to each other in a known manner that prevents their axial and rotational movement relative to each other. Drive shaft 98 and second motor 44 are operably coupled through drive train 110. Motor 44 and drive train 110 are both secured to chassis 38 inside housing 32, and comprise part of first control module subassembly 102 shown in FIGS. 13A and 14. Accordingly, hanger mount 92 is drivably rotated in angular directions about axis 72 relative to control module chassis 38, by second motor 44 through drive train 110. When apparatus 100 is operational, hanger mount 92 is fixed relative to stand 60. Control module 30, swing arm 20 coupled thereto, and target 10 attached to swing arm end 22, are thus moveable in angular directions about axis 72 under the influence of second motor 44 during operation of apparatus 100.

Figure 13A:
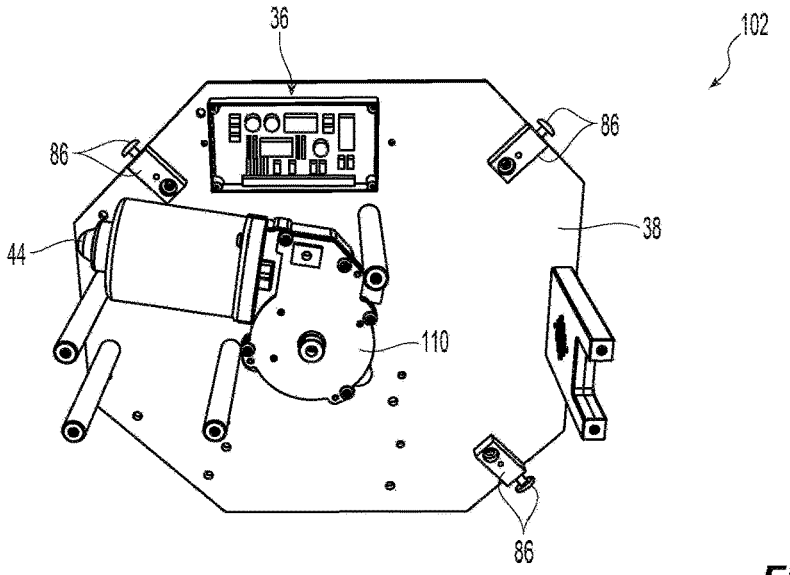
FIG. 13A shows a rear perspective view of a partial first subassembly of the control module of FIG. 6.
Figure 13B:
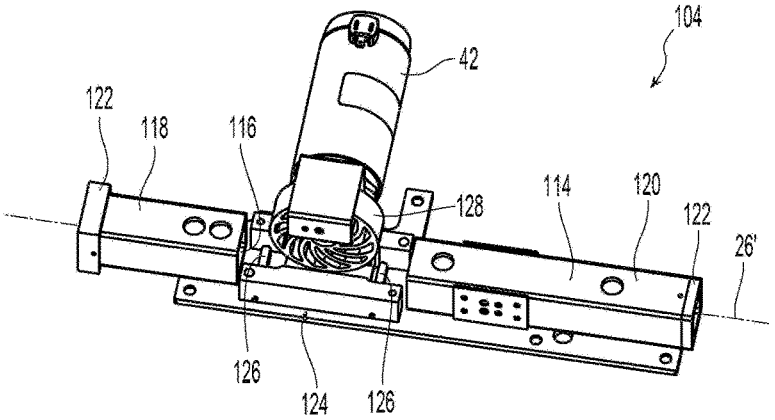
FIG. 13B shows a front perspective view of a partial second subassembly of the control module of FIG. 6.
Figure 15:
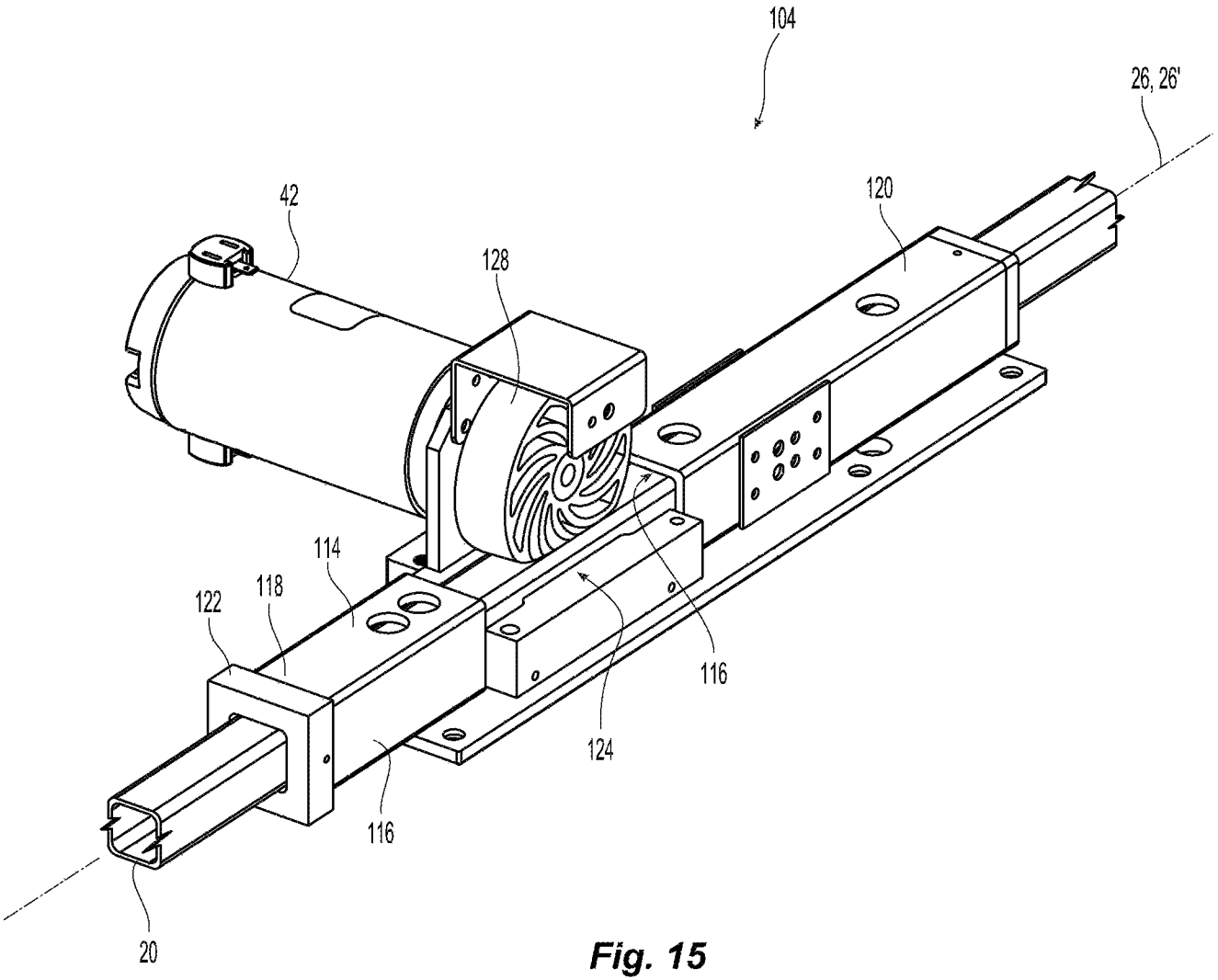
FIG. 15 shows another front perspective view of the partial second subassembly of FIG. 13B, with a section of the swing arm shown extending through its guide member channel.

Control module 30 also comprises second subassembly 104, which is partially shown in FIGS. 13B and 15. Second control module subassembly 104 comprises elongate guide member 114 that is attached to first control module subassembly 102, and first electric motor 42 attached to guide member 114. Elongate guide member 114 defines channel 116 receivable of swing arm 20 and extending between longitudinally opposite first and second axial ends 118 and 120, respectively. Channel axial ends 118, 120 are open to the exterior of housing 32 through sidewall(s) 82. Each end 118, 120 is fitted with a self-lubricating bushing 122 that both surround and together define longitudinal axis 26' (FIG. 13B). When received in channel 116, swing arm 20 slidably engages bushings 122, and axes 26 and 26' are substantially coextensive and axially surrounded by portions of channel 116.

Between channel axial ends 118, 120 a longitudinal section 124 of channel 116 is configured such that it does not axially surround axis 26'. Within section 124, guide member 114 is provided with a pair of spaced, parallel roller bearings 126 whose rotational axes extend in directions perpendicular to axis 26' and lie in an imaginary plane parallel to axis 26', as best shown in FIG. 13B. When received within channel 116, swing arm 20 is supported by bearings 126. The output shaft of motor 42 is provided with friction wheel 128 whose outer diameter frictionally engages interfacing side surface of swing arm 20 that extends along swing arm axis 26, at a contact location axially between bearings 126. Rotation of motor 42 and friction wheel 128 induce linear movement of swing arm 20 along axis 26 relative to control module 30. Swing arm 20 and target 10 connected to swing arm end 22 are thus moveable in linear directions along longitudinal axis 26 under the influence of first motor 42 during operation of apparatus 100.

Figure 13C:
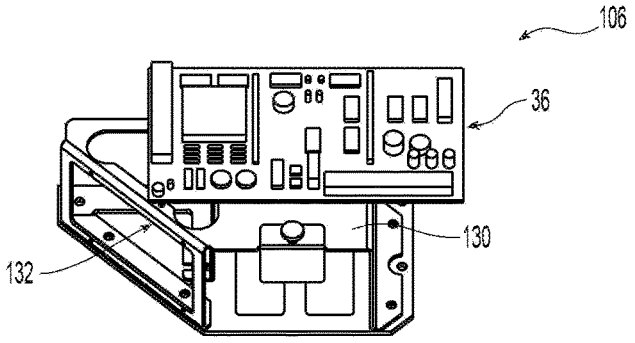
FIG. 13C shows a rear perspective view of a partial third subassembly of the control module of FIG. 6.
Figure 14:
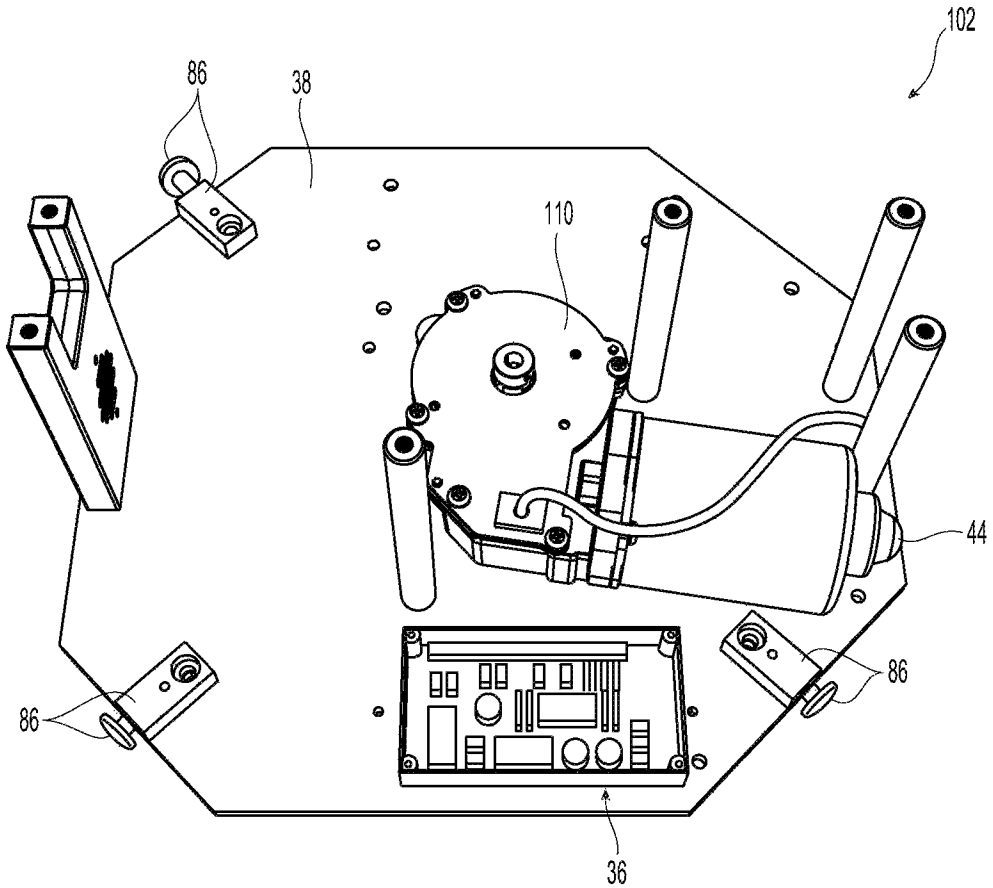
FIG. 14 shows the partial first subassembly view of FIG. 13A enlarged and rotated approximately about the control module axis of rotation.
Figure 16:
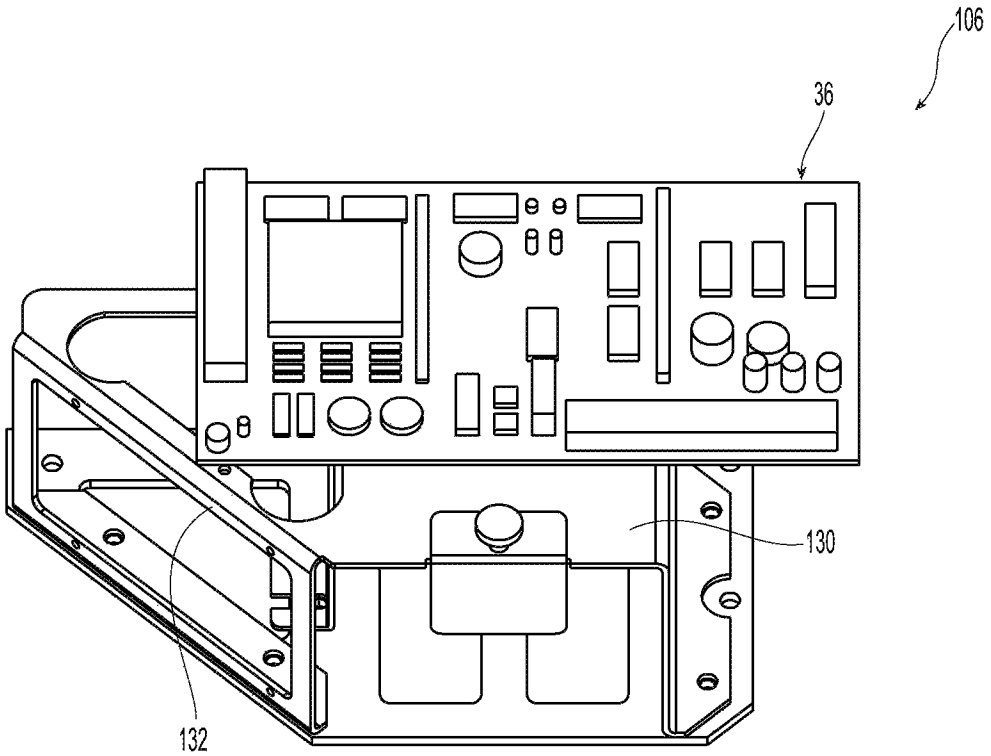
FIG. 16 shows the partial third subassembly view of FIG. 13C enlarged.

Control module 30 also comprises third subassembly 106, which is partially shown in FIGS. 13C and 16. Third control module subassembly 106 comprises support member 130 that is attached to the interior surface of plate 38 of first control module subassembly 102. Control panel 40 is in electrical communication with controller 36, and is attached to exterior of a housing sidewall 82 and an abutting portion 132 of support member 130 that faces radially outward relative to axis 72. In the depicted embodiment, a first part of controller 36 is mounted to support member 130 within housing 32, and a second part of controller 36 is mounted to chassis 38 as shown in FIGS. 13A and 14. Control module 30 may be provided with a handle 134 (FIG. 12) to facilitate the portability of apparatus 100.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. An apparatus for randomly moving a target in space, said apparatus comprising:

a housing rotatable during operation of the apparatus about an axis of rotation;

a drive assembly disposed within the housing, said drive assembly comprising: a pair of electric motors and a programmable controller disposed within the housing, said electric motors operably attached to said controller;

an elongate arm having opposite first and second ends, the arm operably connectable to the drive assembly and adapted for being independently moveable by the pair of electric motors in linear directions along a longitudinal axis fixed relative to the housing and in angular directions about the axis of rotation in response to instructions from said controller; and a target, said target removably attached to the arm first end, the attached target moveable with the arm.

2. The apparatus of claim 1, wherein the movements of the arm in linear directions along the longitudinal axis of the arm and in angular directions about the housing axis of rotation are substantially coplanar.

3. An apparatus for randomly moving a target in space, said apparatus comprising:

a housing rotatable during operation of the apparatus about an axis of rotation;

a drive assembly disposed within the housing, said drive assembly comprising:

a pair of electric motors, and a programmable controller operably connected to each of the pair of electric motors;

an elongate arm having longitudinally spaced first and second ends, each electric motor of the pair of electric motors operably engageable with said arm, movement of the arm linearly in directions extending between the first and second ends being imparted by one electric motor of the pair of electric motors; and a target, said target removably attached to one of said first and second ends, movement of the attached target in angular directions about the axis of rotation being imparted by the other electric motor of the pair of electric motors;

wherein the movements imparted by the one electric motor and the other electric motor of the pair of electric motors are independent of each other.

4. The apparatus of claim 3, wherein the housing is angularly moveable about the axis of rotation, angular movements of the housing about the axis of rotation being imparted by the other electric motor of the pair of electric motors; and wherein the arm and the housing are configured for angular movement in unison;

whereby angular movement of the attached target is imparted by said other electric motor through the housing.

5. An apparatus for randomly moving a target in space, said apparatus comprising:

a housing rotatable during operation of the apparatus about an axis of rotation;

an arm having longitudinally spaced first and second ends;

a drive assembly disposed within the housing, said drive assembly comprising:

a programmable controller, and a pair of electric motors, said pair of electric motors operably attached to said controller and to said arm, said drive assembly adapted for independently moving the arm in linear directions along an axis fixed relative to the housing and extending between the first and second ends of the arm and in angular directions in unison with the housing about the axis of rotation in response to instructions from said controller; and a target, said target removably attached to one of the first and second ends of the arm, the attached target moveable with the arm.

6. The apparatus of claim 5, wherein the movements of the arm in linear directions and in angular directions are substantially coplanar.

* * * * *